US005386747A

United States Patent [19]

Grover

[11] Patent Number: 5,386,747

[45] Date of Patent: Feb. 7, 1995

[54] QUICK RELEASE RATCHET WITH SAFETY LATCH

[75] Inventor: Donald A. Grover, Kenosha, Wis.

[73] Assignee: Snap-on Incorporated, Kenosha, Wis.

[21] Appl. No.: 159,000

[22] Filed: Nov. 30, 1993

[51] Int. Cl.[6] ..... B25B 13/46

[52] U.S. Cl. ..... 81/63; 81/177.85

[58] Field of Search ..... 81/177.85, 60–63.2

[56] References Cited

U.S. PATENT DOCUMENTS

| | | | |
|---|---|---|---|
| 470,954 | 3/1892 | Sinclair . | |
| 2,570,779 | 10/1951 | Dodge et al. . | |
| 3,172,675 | 3/1965 | Gonzalez . | |
| 3,299,750 | 1/1967 | Campanile et al. . | |
| 3,924,493 | 12/1975 | Penner . | |
| 4,211,127 | 7/1980 | D'Oporto et al. | 81/177.85 X |
| 4,631,989 | 12/1986 | Trowbridge et al. . | |
| 4,824,280 | 4/1989 | Alter . | |
| 4,848,196 | 7/1989 | Roberts . | |
| 4,865,485 | 9/1989 | Finnefrock, Sr. . | |
| 4,905,549 | 3/1990 | Nickipuck . | |
| 4,932,293 | 6/1990 | Goff . | |

*Primary Examiner*—D. S. Meislin
*Attorney, Agent, or Firm*—Emrich & Dithmar

[57] ABSTRACT

A quick-release reversible ratchet wrench has a control rod which extends through a bore in the ratchet drive body and the drive lug thereof for axial movement to shift a detent ball in the drive lug between coupling and release conditions. The control rod is urged to the coupling position by a helical compression spring in the bore which engages an annular shoulder at the upper end of the control rod. A second spring member has ends clamped to the drive body by an anchor plate and a flexible bearing portion which bears against a side of the control rod in a circumferential groove, between the annular shoulder and an enlarged head, for tilting the control rod laterally to hold the annular shoulder in engagement with the drive body to prevent accidental axial movement of the control rod to its release position. The anchor plate has a cover portion which covers and protects the reversing lever of the ratchet assembly and guards the control rod. An annular spacer may be disposed between the compression spring and the annular shoulder of the control rod.

16 Claims, 1 Drawing Sheet

10
11
11a
2
2
55
64
35
47
16
60
64

11
40
48
44
47
55
61
60
18
22
13
5
23
21
14
38
65
37
35
16
15
5
32
20
50
41
36
34
24
27
33
19
22a
21a
51
42
12
31
39
37a
30
17
28
43
29
25
26

44
46
23
45
41
20
50

55
57
64
60
16
62
48
44
35
23
61
64
57
58
65
62

64
60
61
63
65
47
62
48
44
56
40
57
58
41
55
42
43
50
51

QUICK RELEASE RATCHET WITH SAFETY LATCH

BACKGROUND OF THE INVENTION

1. Field of the Invention

The present invention relates to drive tools such as those with square drives of the type adapted for securely retaining sockets or other tool attachments thereon and easily releasing them therefrom. The invention has particular application to reversible ratchet wrenches.

2. Description of the Prior Art

Drive tools, such as ratchet wrenches, for coupling to associated sockets or other drive elements or attachments, are well known in the art. One type of such drive tools includes a quick-release mechanism to facilitate disengagement of the socket or other drive attachment from the tool. One such quick-release drive tool, disclosed in U.S. Pat. No. 3,713,356, is a reversible ratchet wrench having a rotatable ratchet drive body with a square drive lug projecting axially therefrom, the drive lug having a detent ball projecting laterally from one side thereof. A control rod is disposed in an axial bore through the drive body and the lug. The control rod is normally held by a compression spring in a coupling position in which it holds the detent ball in a socket-engaging position projecting from the drive lug. The control rod is manually depressible against the urging of the spring to allow the ball to move to a release position to permit easy removal of the socket or other drive attachment. The tool is also provided with a reversing lever which is pivotally movable for changing the direction of ratcheting movement of the drive body. The reversing lever may or may not have an intermediate neutral or locking position in which the ratchet mechanism is disabled.

One difficulty with such a quick-release drive tool is that the control rod or release button can be accidentally depressed, particularly when the tool is being used in close quarters, thereby accidentally releasing the socket or other drive attachment. Another difficulty is that the ratchet reversing lever is also susceptible to accidental movement in use, thereby inadvertently either disengaging the ratchet mechanism or reversing its direction.

SUMMARY OF THE INVENTION

It is an object of the present invention to provide an improved drive tool which avoids the disadvantages of prior drive tools while affording additional structural and operating advantages.

An important feature of the invention is the provision of a quick-release drive tool for use with drive attachments, which inhibits accidental operation of the release mechanism.

In connection with the foregoing feature, another feature of the invention is the provision of a drive tool of the type set forth, which permits latching of the release mechanism.

Still another feature of the invention is the provision of a reversible ratchet assembly having a direction-selecting member and which inhibits accidental movement of the selecting member.

A still further feature of the invention is the provision of a reversible ratchet wrench with a quick-release mechanism which inhibits accidental operation of either the release mechanism or the reversing mechanism.

A still further feature of the invention is the provision of a drive tool of the type set forth which is of relatively simple and economical construction.

These and other features of the invention are attained by providing a drive tool comprising: a drive body adapted for releasable coupling to an associated drive element, a release mechanism shiftable between coupling and release conditions relative to the associated drive element, latch structure on the drive body and the release mechanism, and a bias member resiliently urging the latch structure to a latched condition when the release mechanism is in its coupling condition for inhibiting movement of the release mechanism to the release condition thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
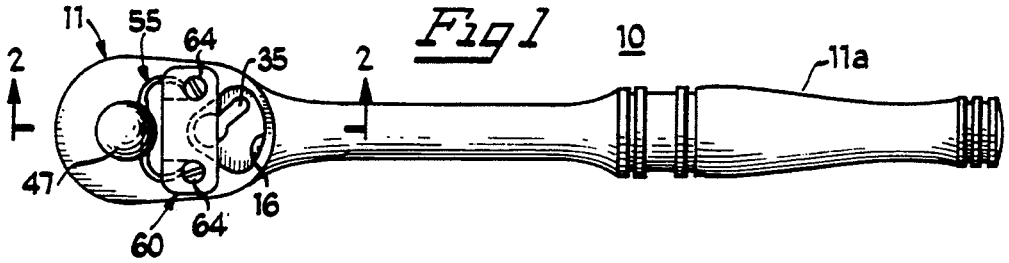
FIG. 1 is a top plan view of a reversible ratchet wrench having a quick release mechanism and constructed in accordance with and embodying the features of the present invention.
Figure 2:
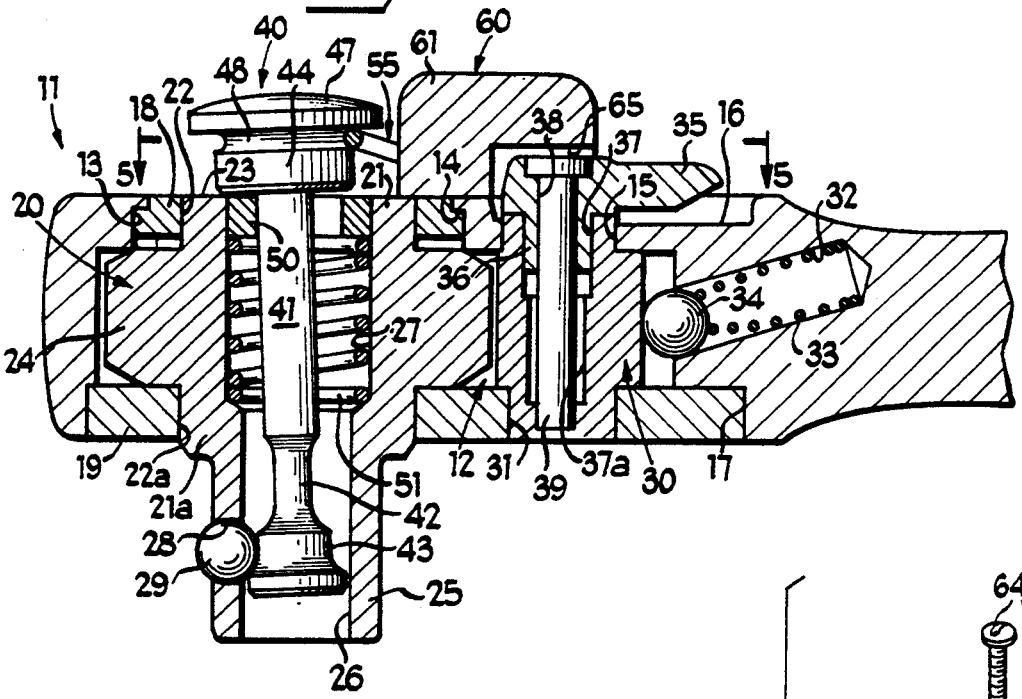
FIG. 2 is an enlarged, fragmentary view in vertical section, taken along the line 2—2 in FIG. 1, and illustrating the release mechanism in its drive element engaging condition.
Figure 5:
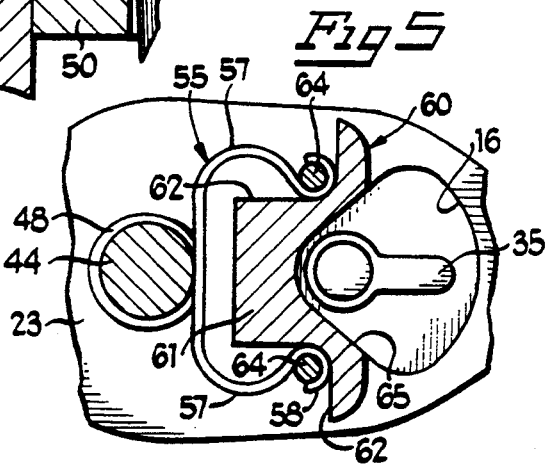
FIG. 5 is a reduced, fragmentary view in horizontal section taken along the line 5—5 in FIG. 2.

Referring to FIGS. 1, 2 and 5, there is illustrated a drive tool in the nature of a reversible ratchet wrench, generally designated by the numeral 10, constructed in accordance with and embodying the features of the present invention. The wrench 10 has an enlarged head 11 and an elongated handle 11*a*, the head 11 having an irregular cavity 12 formed in the underside thereof. An opening 13 formed in the top of the head 11 communicates with the cavity 12 and has an undercut shoulder 14 formed thereon. A circular bore 15 is formed in the top of the head 11 rearwardly of the opening 13 and also communicates with the cavity 12. A shallow, generally wedge-shaped recess 16 is formed in the upper surface of the head 11 adjacent to the handle 11*a*. An enlarged, oval recess 17 is formed in the bottom of the head 11 around the perimeter of the cavity 12. The cavity 12 is closed by a top closure plate 18 seated in the opening 13 against the shoulder 14, and by a bottom closure plate 19 seated in the recess 17.

Disposed in the cavity 12 is a ratchet drive body 20 having central, generally cylindrical hub portions 21 and 21*a* journalled in complementary bores 22 and 22*a*, respectively formed in the top and bottom closure plates 18 and 19. The hub 21 has a circular upper end surface which is disposed in use substantially coplanar with the upper surfaces of the head 11 and the top closure plate 18, and defines a latch surface 23 for a purpose to be explained more fully below. The drive body 20 has a plurality of radially outwardly extending teeth 24 circumferentially spaced apart therearound, and has a square drive lug 25 depending axially from the lower end thereof and projecting below the head 11. A circularly cylindrical bore 26 is formed axially through the drive body 20 and the drive lug 25, having an enlarged-diameter counterbore 27 at the upper end thereof. Formed through the side wall of the drive lug 25 is a side recess 28, which communicates with the axial bore 26 and receives therein a detent ball 29, all in a known manner.

A pawl 30 is journalled in the bore 15 in the head 11 and in a coaxial bore 31 in the bottom closure plate 19. Formed in the rear end of the head 11 and communicating with the cavity 12 is an inclined hole 32, receiving therein a helical compression spring 33 which resiliently urges a detent ball 34 into engagement with the rear end of the pawl 30 to retain it in one of two rotational positions, respectively accommodating ratcheting rotation of the drive body 20 in opposite directions, in a known manner. The pawl 30 is provided with a reversing lever 35 having a depending hub 36 which is matingly received in the square upper end 37 of an axial bore 37*a* through the pawl 30 for effecting rotation thereof. A coaxial bore 38 is formed through the hub 36. A headed pin 39 is received through the bores 37*a* and 38 for retaining the reversing lever 35. The reversing lever 35 is seated in the head recess 16 and preferably projects only a slight distance thereabove to accommodate manual rotation thereof between the forward and reverse positions, again in a known manner.

Figure 4:
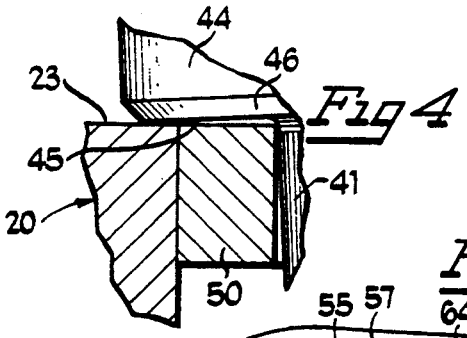
FIG. 4 is an enlarged, fragmentary, sectional view of the latching portion of the quick release mechanism of FIG. 2.
Figure 3:
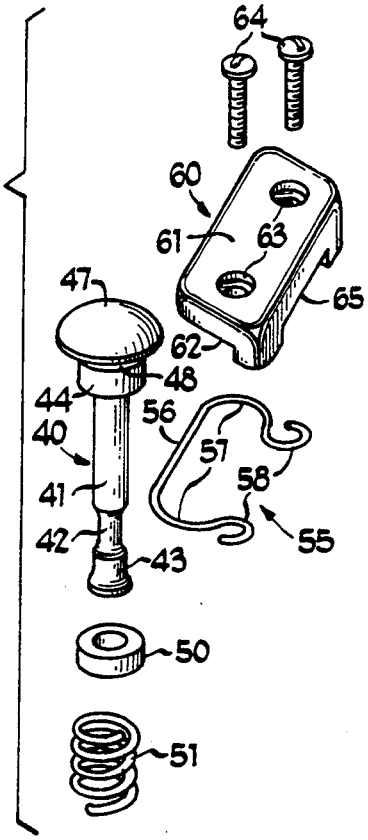
FIG. 3 is a reduced, perspective, exploded view of the quick release mechanism of FIG. 2.

Referring now also to FIGS. 3 and 4, the ratchet wrench 10 has a quick-release assembly which includes an elongated control rod 40 disposed in the axial bore 26 through the drive body 20. The control rod 40 has an elongated, circularly cylindrical shank 41 provided adjacent to the lower end thereof with a reduced-diameter portion 42 which, in turn, joins a cam portion 43 having an outer surface which is arcuately concave in transverse cross section at its lower end, as viewed in FIG. 2. The shank 41 is provided at its upper end with an enlarged-diameter shoulder 44 which projects radially outwardly of the shank 41 and defines on its underside an annular latch surface 45, which is joined by a bevel 46 to a cylindrical side surface of the shoulder 44. The control rod 40 has an enlarged-diameter head 47. Formed in the shoulder 44 at its junction with the head 47 is a circumferential groove 48. Disposed immediately beneath the shoulder 44 in surrounding relationship with the shank 41 is an annular spacer 50 which is, in turn, engaged with a helical compression spring 51 seated in the counterbore 27.

It will be appreciated that, in operation, the spring 51 resiliently urges the control rod 40 upwardly, as viewed in FIG. 2, to a coupling position, in which the cam portion 43 engages the detent ball 29 and forces it into the side recess 28, so that it projects laterally outwardly of the drive lug 25 a predetermined distance. In this condition, the detent ball 29 is disposed for engagement with a detent recess in an associated socket or other drive attachment to retain the drive attachment on the drive lug 25, in a known manner. The control rod head 47 projects well above the head 11 of the ratchet wrench 10 to permit manual axial depression of the control rod 40 by a user against the urging of the spring 51 to a release position (not shown), in which the reduced-diameter portion 42 of the control rod 40 is alongside the detent ball 29. In this position, the control rod 40 accommodates lateral inward movement of the detent ball 29 to a release condition permitting free removal of the socket or other drive attachment from the drive lug 25, again in a known manner.

A significant aspect of the present invention is that the control rod 40 can be latched in its coupling position, illustrated in FIG. 2. In this regard, there is provided a latch spring 55 which is in the form of a generally C-shaped spring wire having a bight 56 and arcuate legs 57 respectively terminating in hook ends 58. The hook ends 58 of the latch spring 55 are retained in place on the head 11 by an anchor plate 60, which has a body 61 generally rectangular in shape. The underside of the body 61 is provided with rectangular corner recesses 62 at the two corners facing the control rod 40 for respectively accommodating the hook ends 58 of the latch spring 55. Formed through the body 61 at the corners of the recesses 62 are two holes 63 (FIG.3) for respectively accommodating screws 64 which are received through the hook ends 58 of the latch spring 55 and which, respectively, extend through complementary bores in the head 11, to threadedly engage the bottom closure plate 19, for fixedly securing the anchor plate 60 to the head 11. Also formed in the underside of the body 61 midway along the rear edge thereof is a generally triangular center recess 65 for accommodating the pivot end of the reversing lever 35.

As can best be seen in FIGS. 1, 2, and 5, the latch spring 55 is so positioned that, when anchored in place as described above, the bight 56 thereof is seated in the groove 48 of the control head 40, as illustrated in FIGS. 1 and 5. It will be appreciated that the latch spring 55 is so shaped and dimensioned as to resiliently urge the upper end of the control rod 40 laterally forwardly, i.e., to the left as viewed in FIGS. 2 and 4, thereby tilting the control rod 40 about its lower end so that the latch surface 45 on the shoulder 44 will slightly overlap the latch surface 23 on the drive body 20 for latching engagement therewith. In this regard, it will be appreciated that the spacer 50 limits the extent of lateral movement of the control rod 40.

When the control rod 40 is thus latched in its coupling position, it cannot be moved to its release position by a simple depressing movement axially of the bore 26. Rather, in order to move the control rod 40 to its release position, it is necessary to first move it a slight distance rearwardly against the urging of the latch spring 55 and then to depress it axially of the bore 26. The axial extent of the spacer 50 cooperates with the spring 51 to limit the axial depressing movement of the control rod 40. Thus, it will be appreciated that this latching arrangement inhibits accidental movement of the control rod 40 to its release position as a result of casual contact with surrounding objects and the like.

The anchor plate 60 is so dimensioned that it substantially overlaps the reversing lever 35, the center recess 65 accommodating the reversing lever 35 to permit operation thereof. The overlapping portion of the anchor plate 60 serves as a guard against accidental engagement of the reversing lever 35 and resulting accidental disengagement of or reversing of the direction of the ratchet assembly. Also, the anchor plate 60 projects slightly above the head 47 of the control rod 40 in its coupling position to serve as a bump guard against accidental depression of the control rod 40 to its release position.

From the foregoing, it can be seen that there has been provided an improved reversible ratchet wrench with a quick-release mechanism which permits the release mechanism to be latched in its coupling position and, at the same time, protects the ratchet reversing lever against accidental contact with surrounding objects in use.

I claim:

1. A drive tool comprising: a drive body adapted for releasable coupling to an associated drive element, a release mechanism carried by said drive body and shiftable between coupling and release conditions relative to the associated drive element, first latch structure on the drive body, second latch structure on the release mechanism, and bias means for resiliently urging said first and second latch structures into latching engagement with each other when the release mechanism is in its coupling condition for inhibiting movement of the release mechanism to the release condition thereof, said release mechanism including an elongated control rod having a longitudinal axis, and support structure supporting said control rod for movement substantially parallel to said axis between said coupling and release conditions of said release mechanism and for movement laterally of said axis between the latched and unlatched conditions of said latch structure.

2. The drive tool of claim 1, wherein said support structure includes means accommodating tilting movement of said control rod about one end thereof between the latched and unlatched conditions of said latch structure.

3. The drive tool of claim 2, wherein said drive body includes a detent member engageable with said control rod for movement thereby between said coupling and release conditions.

4. In a drive tool for use with an associated drive element and including a drive body having a drive lug projecting therefrom and an axial bore through said lug, a detent member in said lug and a control rod disposed in said bore for movement between a coupling position holding said detent member in a drive element engaging condition and a release position accommodating movement of said detent member to a drive element releasing condition, and a first bias member resiliently urging said control rod to its coupling position, the improvement comprising: a first latching portion on the drive body, a second latching portion on the control rod, and a second bias member carried by the drive body and engageable with the control rod for resiliently urging the control rod laterally to a latching position wherein said first and second latching portions are in latching engagement with each other for inhibiting axial movement of the control rod to is release position, said control rod being laterally movable against the urging of said second bias member to an unlatching position disengaging said first and second latching portions from each other for accommodating axial movement of the control rod to its release position.

5. The drive tool of claim 4, wherein said second latching portion includes an annular shoulder on the control rod extending radially outwardly therefrom.

6. The drive tool of claim 5, wherein the first bias member is a helical compression spring disposed in the bore, and further comprising an annular spacer disposed in surrounding relationship with the control rod and dimensioned for limiting the lateral movement of the control rod.

7. The drive tool of claim 5, wherein said first latching portion includes a surface on the drive body around the periphery of the bore.

8. The drive tool of claim 4, wherein said second bias member comprises a flexible spring member having opposite ends fixed to the drive body and a bearing portion intermediate said ends engageable with the control rod.

9. The drive tool of claim 8, wherein the control rod has a circumferential groove formed in the outer surface thereof adjacent to one end thereof, said bearing portion of said spring member being engageable in said groove.

10. The drive tool of claim 4, wherein the drive tool is a ratchet wrench.

11. In a reversible ratchet assembly including a drive body for releasable coupling to an associated drive element and operable in forward and reverse ratcheting directions, a reversing lever for controlling the direction of operation of the ratchet assembly, and a release mechanism shiftable between coupling and release conditions relative to the associated drive element, the improvement comprising: first latch structure on the drive body and second latch structure on the release mechanism, bias means for resiliently urging said first and second latch structures into latching engagement with each other when the release mechanism is in its coupling condition for inhibiting movement of the release mechanism to the release condition thereof, and an anchor member mounting said bias means on the drive body, said anchor member having a cover portion overlying and protecting the reversing lever.

12. The ratchet assembly of claim 11, wherein the bias means is an elongated spring having opposite ends fixed to the drive body and a bearing portion intermediate said ends engageable with the release mechanism.

13. The ratchet assembly of claim 12, wherein said spring ends are respectively bent into loops, said loop ends being disposed between the drive body and said anchor member, and further including threaded fasteners received through said anchor member and said loop ends and engageable with the drive body for clamping the spring member thereto.

14. The ratchet assembly of claim 11, wherein the release mechanism includes an elongated control rod, and structure supporting said control rod for compound movement between the coupling and release conditions.

15. The ratchet assembly of claim 14, wherein said support structure includes means accommodating lateral and axial movements of said control rod.

16. The ratchet assembly of claim 14, wherein said control rod has a manually engageable portion, said anchor member projecting beyond said manually engageable portion when said release mechanism is in its coupling condition.

* * * * *

UNITED STATES PATENT AND TRADEMARK OFFICE

CERTIFICATE OF CORRECTION

PATENT NO. : 5,386,747

DATED : February 7, 1995

INVENTOR(S) : Donald A. Grover

It is certified that error appears in the above-indentified patent and that said Letters Patent is hereby corrected as shown below:

On the title page, item [56], add the following:

| | | |
|---|---|---|
| --4,938,107 | 7/90 | Nickipuck |
| 5,090,275 | 2/92 | McCann |
| 5,214,986 | 6/93 | Roberts |
| 3,713,356 | 1/73 | Knudsen-- |

Signed and Sealed this

Second Day of May, 1995

*Attest:*

*Attesting Officer*

BRUCE LEHMAN

*Commissioner of Patents and Trademarks*